United States Patent [19]

McNeil

[11] 4,139,192

[45] Feb. 13, 1979

[54] ROUND TRAMPOLINE WITH U-SHAPED LEG

[76] Inventor: Harold L. McNeil, 3120 Flastacowo Rd., Tallahassee, Fla. 32302

[21] Appl. No.: 724,257

[22] Filed: Sep. 17, 1976

[51] Int. Cl.[2] ..... A63B 5/18

[52] U.S. Cl. ..... 272/65; 403/293

[58] Field of Search ..... 272/65, 70, 72, 71, 272/109, 66; 248/165, 188, 151; 47/39; 182/139; 5/110, 127; 297/440, 442

[56] References Cited

U.S. PATENT DOCUMENTS

| | | | |
|---|---|---|---|
| 3,502,327 | 3/1970 | Meyer | 272/66 |
| 3,561,564 | 4/1969 | Russell | 272/65 |
| 3,891,208 | 6/1975 | Sidlinger | 272/65 |
| 3,948,515 | 4/1976 | McNeil | 272/65 |

FOREIGN PATENT DOCUMENTS

| | | | |
|---|---|---|---|
| 2510049 | 9/1975 | Fed. Rep. of Germany | 272/65 |
| 919990 | 2/1973 | United Kingdom | 272/65 |

*Primary Examiner*—Richard C. Pinkham

*Assistant Examiner*—William R. Browne

*Attorney, Agent, or Firm*—Clarence A. O'Brien; Harvey B. Jacobson

[57] ABSTRACT

A round trampoline having a sectional, circular frame combined with a circular mat of lesser diameter than the frame resiliently supported from the frame by a plurality of radially arranged coil springs. A plurality of U-shaped legs support the frame with each U-shaped leg being of rigid, one-piece construction and rigidly connected to the frame in bridging relation to the joints in the segments of the frame to prevent relative rotation between the segments and eliminate bending of the frame at the joints. The mat includes a pair of intersecting and overlapping strips oriented in perpendicular relation to each other to form a reinforced center jumping area with the portions of the mat externally of the intersecting portions being of mesh material to enable passage of air in order to prevent ballooning of the mat and to eliminate the feeling of being air supported when contacting the mat.

5 Claims, 4 Drawing Figures

ROUND TRAMPOLINE WITH U-SHAPED LEG

BACKGROUND OF THE INVENTION

1. Field of the Invention

The present invention generally relates to a round trampoline and more particularly a trampoline of this type in which the circular frame forming the trampoline is sectional and provided with U-shaped supporting legs bridging the joints between the sections with the U-shaped legs being free of and not connected with adjacent legs or other legs on the frame with the circular frame supporting a mat having a central double thickness or reinforced area and a peripheral area of mesh material enabling air passage therethrough.

2. Description of the Prior Art

My prior U.S. Pat. No. 3,948,575, issued Apr. 6, 1976, discloses a circular trampoline of the type disclosed herein. The references of record in that patent disclosre various trampoline structures and while prior trampolines have functioned successfully, improvements of the structural characteristics thereof are desirable in order to overcome certain problems relating to the strength of the frame especially in the joints between adjacent segments of the frame and in the mat which tends to balloon or provide a "squooshy" feeling when constructed of air impervious material throughout its area.

SUMMARY OF THE INVENTION

An object of the present invention is to provide a round trampoline having a sectional frame with an improved U-shaped leg construction bridging the joint between adjacent segments of the frame and rigidly but detachably secured to the frame in a manner to prevent bending of the frame and relative rotation between the segments of the frame due to forces exerted thereon by a person using the trampoline.

Another object of the present invention is to provide a round trampoline having a circular mat formed by a pair of intersecting strips to provide a double thickness, reinforced central area together with fill-in pieces to form a circular configuration with the portion of the mat exteriorly of the double thickness area being of a mesh material enabling passage of air to reduce the ballooning effect and eliminate a soft or "squooshy" feeling which occurs due to air tending to support the mat during use.

Still another object of the present invention is to provide a round trampoline having a circular frame of a single tubular member constructed in arcuate segments joined together by U-shaped legs of one-piece construction which bridge the joint between adjacent segments of the frame with the legs forming the sole support for the frame and being totally isolated from each other thereby eliminating the need for braces between the lower portions of adjacent or diametrically opposed legs and thus maintaining the cost of the trampoline at a desired minimum and providing a trampoline in which the frame will not be subject to bending or rotation between adjacent segments at the joints due to the connection of the legs to the frame which is in the form of a telescopic association between the upper ends of the U-shaped legs and depending stems or sleeves fixed to the frame sections in spaced relation to the joints between adjacent frame sections.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
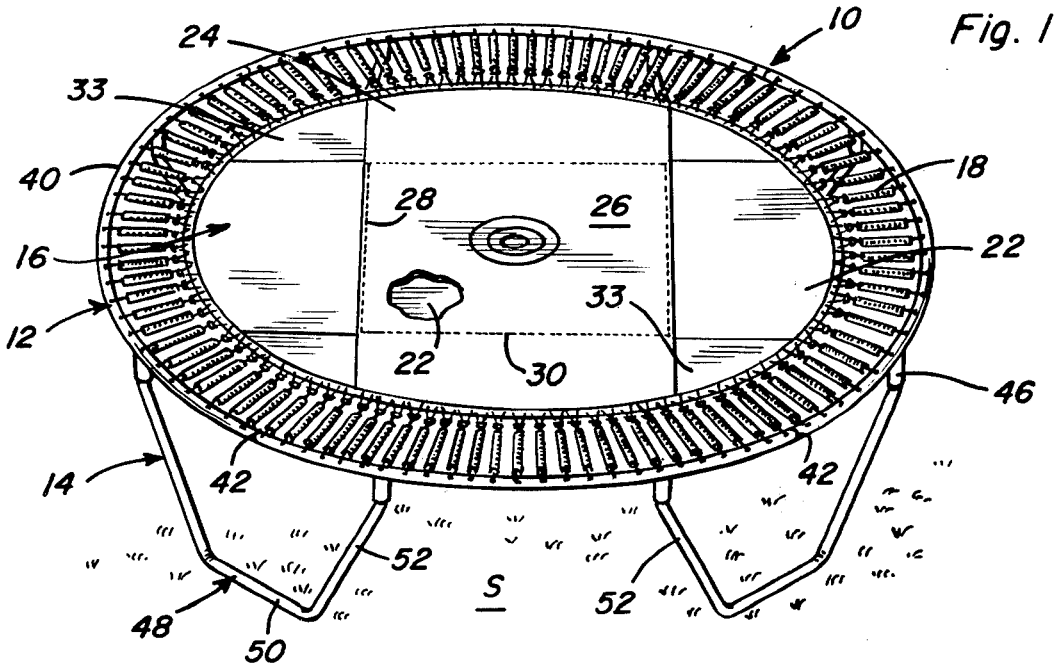
FIG. 1 is a perspective view showing the round trampoline of the present invention.

Referring now to the drawings, the trampoline of the present invention is generally designated by reference numeral 10 which includes a sectional, substantially circular frame 12 provided with U-shaped supporting legs 14 which support the frame 12 on a suitable support surface S. A substantially circular mat 16 is resiliently mounted within frame 12 by a plurality of coiled springs 18. The springs 18 are placed radially around the frame 12 which distributes the weight of a person jumping on the trampoline evenly to all of the springs 18 with resultant longer spring life. This arrangement also provides forces which tend to retain the jumper in the center of the mat 16 thus providing better body control and less chance of injury which sometimes can occur when a person using a trampoline jumps to the side edge portion thereof and engages the frame or possibly the ground surface.

Mat 16 includes a pair of strips 22 and 24 each having ends thereof curved to the same radius and being arranged in perpendicular relation to provide a double thickness center jumping area with the intersecting portions of the mat being stitched at 28 and 30 so that the jumping area 26 is reinforced. A backing ring 31 reinforces the perimeter of the mat and is stitched to the strips 22 and 24 by stitching 32 and filler pieces 33 of vinyl covered nylon are stitched to the ring 31 and strips 22 and 24. A plurality of straps 34 are secured to the ring 31 and a conventional D-ring 36 is arranged for receiving a hook end of springs 18. The other hook end of the springs 18 is arranged in a respective hole 38 provided in rail 40 of frame 12.

The mat material is preferably of woven polypropylene or similar material with the material being of mesh construction so that those areas which are of single thickness, such as all of the areas externally of the central jumping area 26 will enable air passage therethrough. This reduces the ballooning effect or air support of the mat during use thereby eliminating the soft or "squooshy" feeling which occurs when the entire mat is of air impervious material.

Figure 2:
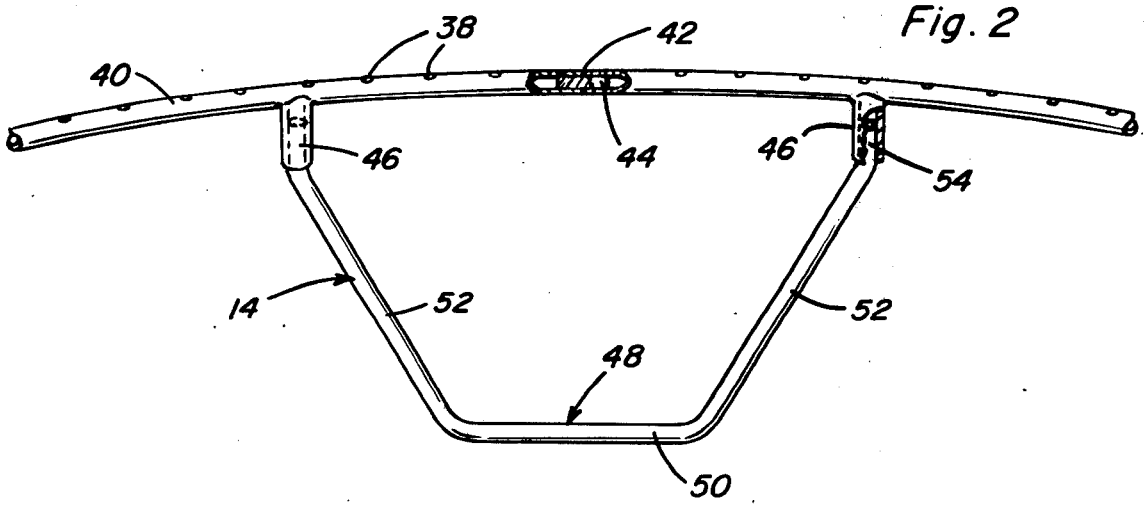
FIG. 2 is a detailed elevational view of one of the U-shaped legs and the associated joint between adjacent sections of the frame.
Figure 3:
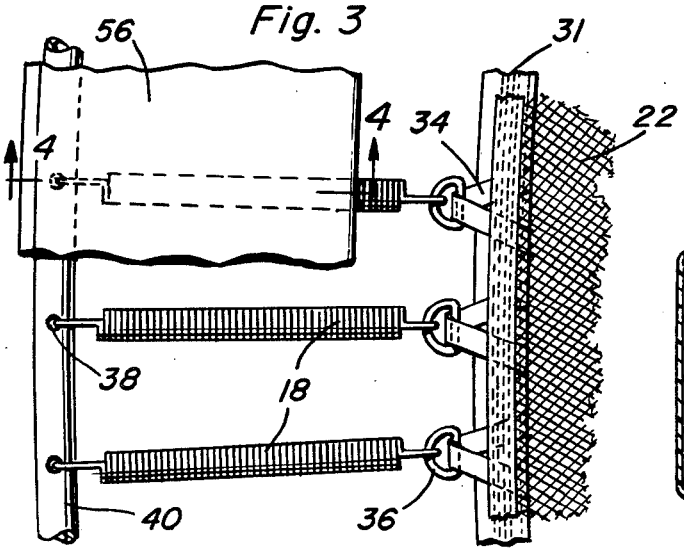
FIG. 3 is a fragmental plan view of a portion of the frame and periphery of the mat.

As illustrated in FIG. 2, the frame rail 40 is in the form of sections with the joint 42 between adjacent sections being connected by a connecting plug 44 rigidly secured to one of the sections of the frame rail 40 and telescoped into the other of the sections. In spaced relation to the joint 42, the frame rail 40 is provided with a depending tubular sleeve 46 fixed thereto such as by welding or the like in perpendicular depending relation. The sleeves 46 are parallel to each other and equally spaced from the joint 42 between adjacent sections of the frame rail 40. A U-shaped supporting leg 48 rigidly connects the frame sections and supports the frame. The U-shaped leg 48 is of one-piece construction and includes a horizontally disposed bottom or bight portion 50 and upwardly inclined and diverging legs 52 each of which terminates in a vertical upwardly extending upper end portion 54 that is telescoped into a depending sleeve 46 thereby bridging the joint 42 and preventing relative rotation of the adjacent sections of the frame 40 due to the telescopic engagement between the upper ends 54 of the legs and the sleeves 46. This prevention of rotation prevents bending of the frame and rigidly connects adjacent sections of the frame rail 40 into a rigid continuous truss-like frame structure peripherally of the mat with the entire area enclosed by the frame being free of connecting braces or other components so that only the bight portions 50 of the plurality of U-shaped supporting legs 48 form supporting means for the trampoline.

Figure 4:
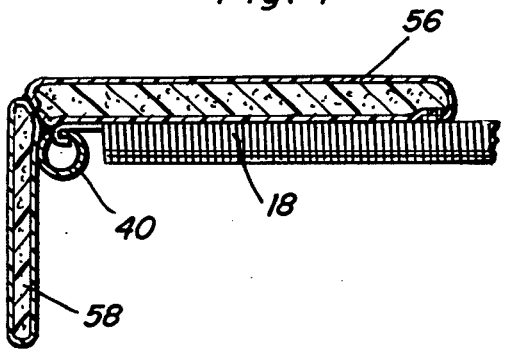
FIG. 4 is a detailed sectional view illustrating the pad associated with the trampoline.

While the telescopic engagement between the upper ends of the legs 48 and the sleeves 46 provides a rigid connection, the jamming of the lower ends of the sleeves 46 around the curved portion of the legs 52 where the ends 54 are formed serves to retain the legs assembled when lifting the trampoline such as when moving it from one area to another. While the dimensional characteristics of the trampoline may vary, an overall diameter of approximately 13½ feet has been found satisfactory with 100 springs 18 being employed. Frame pads 56 are provided over the springs 18 and the frame rail 40 as illustrated in FIG. 4 with the pads 56 being preferably in the form of a hollow enclosure formed by any suitable waterproof material such as vinyl material or the like filled with a resilient material such as foam rubber, foam plastic or other cushioning material to completely eliminate the possibility of injury due to persons using the trampoline coming into contact with the frame rail, springs or associated components. The pad 56 has a depending padded skirt 58 around the frame rail 40 which retains the pad in place and protects against contact with the rail during use of the trampoline.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A round trampoline comprising a sectional, substantially circular frame including a frame rail formed by a plurality of arcuate sections, means joining the ends of adjacent sections, a substantially rigid U-shaped leg underlying the frame rail and bridging the joint between each pair of adjacent sections with the U-shaped leg including upper ends, means releaseably securing the tupper ends of each leg to adjacent sections of the frame rail in longitudinally spaced relation to the joint between adjacent sections of the frame rail for preventing relative rotation between adjacent sections of the frame rail and preventing lateral bending of the frame rail.

2. The structure as defined in claim 1 wherein said securing means includes a pair of depending members rigid with and perpendicular to each frame rail section, each depending member being disposed in adjacent but spaced relation to an end of the frame rail section, each U-shaped leg including substantially vertical upper ends telescoped in rigid relation to the depending members on the frame rail sections for rigidifying the frame rail sections and leg and preventing rotation of the frame rail sections, each U-shaped leg including downwardly converging leg portions extending from the upper ends with the lower ends of the leg portions being interconnected by a bight portion bridging the joint between adjacent sections, each U-shaped leg being of one-piece construction with the bottom portions of the legs forming the sole support for the trampoline and being generally in alignment with the frame rail.

3. The structure as defined in claim 2 together with a mat supported within said circular frame, said mat being substantially circular and concentric with respect to the frame, a plurality of radial springs of equal length and equally spaced circumferentially between the mat and frame, said mat being constructed of a pair of perpendicular intersecting strips of flexible, porous, fabric like material, each strip having a width of approximately one-half of the diameter of the frame rail thereby providing a dual thickness central jumping area, the portion of the mat exteriorly of the central jumping area being of mesh construction to enable passage of air therethrough to prevent ballooning of the mat and eliminate the soft or "squooshy" feeling caused by air support of the mat during use, and filler pieces of fabric like material connected to the side edges of the strips outwardly of the jumping area and combining with the strips to form a circular mat, said strips being of woven polypropylene and the filler pieces and strips are stitched together along the side edges thereof.

4. The structure as defined in claim 3 wherein said frame rail sections are tubular, said means joining the ends of adjacent arcuate sections including a plug rigid with one of said frame sections and snugly telescoped into the end of an adjacent frame section, said springs exerting an inward force on said frame rail sections to retain the sections in assembled relation, said upper ends of the U-shaped leg engaging the depending members on adjacent sections of the frame rail preventing outward expansion of the frame rail, said depending members being tubular sleeves and receiving the upper ends of the U-shaped legs therein, and a peripheral cushioning pad overlying the frame rail and extending radially inwardly to cover a major portion of said springs, said pad including a depending padded skirt extending downwardly around the outside of the frame rail a short vertical distance to cover the outer periphery of the frame rail and retain the pad in position.

5. The structure as defined in claim 1 together with a mat supported within said circular frame, said mat being substantially circular and concentric with respect to the frame, a plurality of radial springs of equal length and equally spaced circumferentially between the mat and frame, said mat being constructed of a dual thickness central jumping area, the portion of the mat exteriorly of the central jumping area being of mesh construction to enable passage of air therethrough to prevent ballooning of the mat and eliminate the soft or "squooshy" feeling caused by air support of the mat during use.

* * * * *